US009173043B2

(12) United States Patent
Bülow et al.

(10) Patent No.: US 9,173,043 B2
(45) Date of Patent: Oct. 27, 2015

(54) METHOD FOR FINE TUNING A HEARING AID

(75) Inventors: Maja Bülow, Varlose (DK); Sueli Aparecida Caporali, Hillerød (DK); Svend Vitting Andersen, Espergaerde (DK)

(73) Assignee: Widex A/S, Lynge (DK)

( * ) Notice: Subject to any disclaimer, the term of this patent is extended or adjusted under 35 U.S.C. 154(b) by 225 days.

(21) Appl. No.: 13/152,395

(22) Filed: Jun. 3, 2011

(65) Prior Publication Data

US 2011/0235835 A1 Sep. 29, 2011

Related U.S. Application Data

(63) Continuation-in-part of application No. PCT/EP2008/067421, filed on Dec. 12, 2008.

(51) Int. Cl.
*H04R 25/00* (2006.01)

(52) U.S. Cl.
CPC ..... *H04R 25/70* (2013.01); *H04R 2225/39* (2013.01); *H04R 2225/55* (2013.01)

(58) Field of Classification Search
USPC ..... 381/314, 60, 312, 323, 328, 380
See application file for complete search history.

(56) References Cited

U.S. PATENT DOCUMENTS

| | | | | |
|---|---|---|---|---|
| 7,027,606 | B2 * | 4/2006 | D'Agri | 381/312 |
| 7,200,237 | B2 | 4/2007 | Zhang et al. | |
| 7,206,416 | B2 * | 4/2007 | Krause et al. | 381/60 |
| 2002/0136365 | A1 | 9/2002 | D'Agri | |
| 2008/0107296 | A1 | 5/2008 | Bachler et al. | |
| 2008/0165980 | A1 | 7/2008 | Pavlovic et al. | |
| 2009/0154741 | A1 * | 6/2009 | Woods et al. | 381/312 |
| 2010/0104122 | A1 * | 4/2010 | Waldmann | 381/314 |

FOREIGN PATENT DOCUMENTS

| | | | |
|---|---|---|---|
| EP | 1376440 | A1 | 1/2004 |
| WO | 01/97564 | A2 | 12/2001 |
| WO | 03/030619 | A2 | 4/2003 |
| WO | 2006/136616 | A2 | 12/2006 |
| WO | 2007/045253 | A1 | 4/2007 |
| WO | 2007/045276 | A1 | 4/2007 |
| WO | 2008/052576 | A1 | 5/2008 |
| WO | 2008/119382 | A1 | 10/2008 |
| WO | 2008/151625 | A1 | 12/2008 |

OTHER PUBLICATIONS

International Search Report for PCT/EP2008/067421 dated Aug. 27, 2009.
Chinese Office Action for Chinese Patent Application No. 200880132165.7 dated Apr. 18, 2013, with English translation.

* cited by examiner

*Primary Examiner* — Ahmad F Matar
*Assistant Examiner* — Sabrina Diaz
(74) *Attorney, Agent, or Firm* — Sughrue Mion, PLLC

(57) ABSTRACT

A method for fitting a hearing aid (1) comprises the steps of recording the audiogram of the hearing aid user (6), selecting a fitting setting, using the hearing aid (1) for a period of time, and logging data representing information on the sound environment in which the hearing aid is being used. The method comprises the steps of providing a computer based questionnaire on a first computer (2), said questionnaire comprising questions directed to the hearing aid users subjective experience with using the hearing aid, correlating questionnaire data with logged data, and selecting and, implementing a new hearing aid setting into the hearing aid. The invention further provides a method for optimizing the function of a hearing aid, and a computer program product.

17 Claims, 1 Drawing Sheet

METHOD FOR FINE TUNING A HEARING AID

RELATED APPLICATIONS

The present application is a continuation-in-part of application No. PCT/EP2008067421, filed on Dec. 12, 2008, with the European Patent Office and published as WO2010066305 A1.

BACKGROUND OF THE INVENTION

1. Field of the Invention

The present invention relates to hearing aids. The invention further relates to methods of adjusting hearing aids. The invention more specifically concerns a method for fitting a hearing aid to the needs of a hearing aid user comprising recording the audiogram of the hearing aid user, selecting a fitting setting and implementing the setting in the hearing aid, using the hearing aid by the hearing aid user for a period of time, and logging data representing information on the sound environment in which the hearing aid is being used, said data being logged in a memory in the hearing aid.

Hearing aids comprise a number of different parameters which are adjusted by an audiologist, or the hearing aid fitter, to the needs of the individual hearing aid user before the hearing aid user starts using the hearing aid. This adjustment is based on a measured audiogram for the hearing aid user. The audiogram provides information on the hearing loss in specific frequency ranges. The parameters are on one hand a number of basic parameters for adapting the hearing aid to the specific hearing loss of the hearing aid user, e.g. the amplification in different frequency bands and the compression. On the other hand more complex features may need adjustment or may be activated or deactivated, e.g. the feedback cancellation, the directional characteristic, transposing higher frequencies to a lower frequency range, noise reduction functions, choice of input source etc. These parameters, especially the first mentioned, are usually also adjusted to different types of listening situations relevant to the individual hearing aid user.

Typically a number of programs are defined for a hearing aid. These programs comprise preselected settings of all parameters in order to optimize the listening situation in specific sound environments. These programs are set up in order to improve the listening situation in different situations, e.g. car driving, listening to music, meeting etc. The hearing aid user can then select the appropriate program in a given sound environment.

2. The Prior Art

The hearing aid may be provided with features for automatic program selection, as described in WO-A1-2007/045253, based on an analysis of the sound environment. However, the hearing aid user will have the possibility of overruling such a selection.

The different parameters, or the settings within different programs, will usually need fine tuning or readjustment at least once, and often several times during the lifespan of the hearing aid. The need for fine tuning often arises as the hearing aid user gets some experience with using the hearing aid in different types of sound environment. The need for fine tuning may also arise from changes in the hearing loss.

The fine tuning is often based on a discussion between the hearing aid user and the fitter, e.g. when the hearing aid is in for a service check. The fine tuning may also be based on a paper questionnaire or diary filled out by the hearing aid user before or during visiting the fitter. Such a questionnaire comprises different categories of questions directed to areas such as physical and functional aspects (e.g. the mechanical fitting of the hearing aid to the ear), general sound quality (e.g. experience with feedback), speech intelligibility in quit surroundings, speech intelligibility in noisy surroundings, soft sounds, loud sounds, comfort in noise, own voice etc.

Based on the subjective response on these questionnaires a score can be achieved within each category, and the fitter may suggest a change in adjustment of the hearing aid.

It is known from EP-A1-1376440 to have a system for handling forms for information over the internet. This disclosure is directed to order forms comprising data for manufacturing an ear piece at a central production facility.

U.S. Pat. No. 7,200,237 discloses a method for performing a general upgrade of the software on a hearing aid by sending the software over the internet.

Besides the subjective questionnaires, the fitter may also have access to data on the sound environment in which the hearing aid has been used. It is known from WO 2007/045276 to log, by the hearing aid, data representing mal information on the sound environment in which the hearing aid is being used.

SUMMARY OF THE INVENTION

One problem with the above mentioned two types of data is that they both only offer the fitter a rough guideline for fine tuning the hearing aid. None of them provide specific information on how the user experiences a sound environment characterized by a physical measured parameter.

It is a feature of the invention to find a method for fine tuning a hearing aid solving the above problems.

The invention, in a first aspect, achieves this feature by a method for fitting a hearing aid to the needs of a hearing aid user comprising the steps of recording the audiogram of the hearing aid user, selecting a fitting setting and implementing the setting in the hearing aid, using the hearing aid by the hearing aid user for a period of time, logging data representing information on the sound environment in which the hearing aid is being used, said data being logged in a memory in the hearing aid, providing a computer-based questionnaire on a first computer, said questionnaire comprising a number of questions directed to the hearing aid users subjective experience with using a hearing aid fitted to the specific hearing loss of the hearing aid user, where each of said questions are to be answered by an indication on a predefined scale, requesting the hearing aid user to fill out said questionnaire, uploading questionnaire data representing the filled out questionnaire to an internet server, downloading said questionnaire data from said internet server to a second computer, transferring said logged data to said second computer, correlating said downloaded questionnaire data with said logged data, wherein data logged in a specified period up to the time for filling out said questionnaire, are compared with the corresponding questionnaire data, selecting a new hearing aid setting, and implementing the new hearing aid setting into the hearing aid.

An advantage of the invention is that data recorded by the hearing aid user concerning the users subjective experience with the application of the hearing aid can be correlated to the data on the sound environment logged by the hearing aid. Such comparison can further be made for data obtained in the same period of time. By the method according to the invention it will thus be possible to see how large a fraction of the time where the hearing aid is being used, it is being used in different types of sound environments, and to compare this information with the score for questions directed to the different types of sound environments.

In an embodiment of a method according to the invention the logged data is transferred from the hearing aid to a computer from which the data is uploaded to the internet server, from where the data can be downloaded to the second computer at the fitter. The hearing aid memory can be emptied from logged data once uploaded. It also makes it possible for the fitter to access all data, both logged data and questionnaire data, before talking with the hearing aid user. The step of transferring logged data from the hearing aid to a computer and uploading these data does not have to be performed in connection with the step of filling out the questionnaire. These two steps, even though part of the same method, can be performed at independent points in times. However, often it may be preferred to perform the two steps more or less at the same time, or at least with a limited time lag, e.g. at the same day or within two days.

In an embodiment of the invention, the questionnaire data and the logged data are analyzed in the same software package on the second computer, said software package being applied for selecting the adjustment of the hearing aid settings. This makes it easier to relate the two datasets to each other, and gives the fitter a better overview.

In another embodiment of the invention, the adjusted hearing aid settings are uploaded to an internet server from where they are downloaded to a computer communicating with the hearing aid, and, following the download to the hearing aid user's computer, the adjusted hearing aid settings are implemented into the hearing aid. Thereby, the hearing aid user does not in principle need to show up at the fitter's office, but may handle the necessary communication over telephone or e-mail.

In a further embodiment of the invention, the questions in said questionnaire are of the multiple choice type, rendering the responses in the filled out questionnaire easily available for statistical analysis. This has the advantage of obtaining a score based on the responses, and facilitating analyzing the responses from a larger number of hearing aid users.

In a further embodiment of the invention, the questionnaire is filled out at least two times on separate days before selecting an adjustment of the hearing aid settings. This may facilitate a more detailed mapping of the user's experience, and it may provide some time information, e.g. does the questionnaire response change over time? By repeated filling out of the questionnaire it might be possible by comparing with the logged data to see if a change in the amount of time spend in different sound environments will lead to a change in the response to some of the questions in the questionnaire.

In an embodiment of the invention, the data logged in a specified period up to the time for filling out said questionnaire are compared with these corresponding questionnaire data in order to estimate an optimum adjustment of the hearing aid settings. This has the advantage of obtaining a better correlation between the two types of data, provided, of course, such a correlation exists. This embodiment and others are dependent on the data logging including some kind of time registration. The internal clock in most hearing aids are, however, not very accurate, partly due to the need for keeping power consumption low. This clock may therefore need frequent calibration, e.g. whenever connected to a computer or through a remote control.

In a further embodiment of the invention such a correlation may be further improved if the questionnaire comprises questions directed to the hearing aid users experience with the hearing aid in a specific time period. The hearing aid user may also benefit from learning how the hearing aid log will classify the sound environments the user is actually spending time in. The user may use this knowledge for selecting the optimal program in a given sound environment.

The invention, in a second aspect, provides a method for optimizing the function of a hearing aid, comprising providing a number of hearing aid users with hearing aids, for each respective user recording the audiogram of the respective hearing aid user, selecting a fitting setting and implementing the setting in the respective hearing aid, using the respective hearing aid by the respective hearing aid user for a period of time, logging data representing information on the sound environment in which the respective hearing aid is being used, said data being logged in a memory in the respective hearing aid, providing a computer-based questionnaire on a respective first computer, said questionnaire comprising a number of questions directed to the respective hearing aid users subjective experience with using a hearing aid fitted to the specific hearing loss of the respective hearing aid user, where each of said questions are to be answered by an indication on a predefined scale, requesting the respective hearing aid user to fill out said questionnaire, uploading questionnaire data representing the filled out questionnaire to an internet server, downloading said questionnaire data from said internet server to a second computer, transferring said logged data to said second computer, and correlating said downloaded questionnaire data with said logged data, wherein data logged in a specified period up to the time for filling out said questionnaire, are compared with the corresponding questionnaire data, wherein the data from respective users collected in the second computer are analyzed statistically in order to identify features of the hearing aid fitting that merit further study.

Such a dataset for a number of hearing aid users, preferably a large number of hearing aid users, e.g. more than 100, will offer valuable and new tool for improving hearing aids.

The invention is further related to the use of the data obtained in carrying out a method according to the invention, from a number of hearing aid users, for improving the hardware or the software in a hearing aid. The number of hearing aid users is at least 25, preferably at least 50 and even more preferably at least 100.

The invention is further related to a method for synchronizing the clock of a hearing aid wherein the clock of the hearing aid is set to the time of the first computer or to the internet time whenever the hearing aid is connected to the first computer for performing any of the methods according to the invention. This could be for uploading data logged by the hearing aid. This synchronization solves the problem of most hearing aids having a relatively inaccurate clock for power saving reasons.

The invention, in a third aspect, provides a computer program product comprising executable program code which, when executed on a computer, correlates downloaded questionnaire data with logged hearing aid data, said two types of data being obtained by providing a user with a hearing aid; recording the audiogram of the hearing aid user; selecting a fitting setting and implementing the setting in the hearing aid; using the hearing aid by the hearing aid user for a period of time; logging data representing information on the sound environment in which the hearing aid is being used, said data being logged in a memory in the hearing aid; providing a computer-based questionnaire on a first computer, said questionnaire comprising a number of questions directed to the hearing aid users subjective experience with using a hearing aid fitted to the specific hearing loss of the hearing aid user, where each of said questions are to be answered by an indication on a predefined scale; requesting the user of said hearing aid to fill out said questionnaire; uploading questionnaire data representing the filled out questionnaire to an internet server; downloading said questionnaire data from said internet server to a second computer; and transferring said logged data to said second computer. This computer program will typically assist the fitter in analyzing the obtained data, and in selecting a new hearing aid setting, i.e. fine tuning the hearing aid.

BRIEF DESCRIPTION OF THE DRAWINGS

Embodiments of the invention will now be explained in further detail with reference to the figures.

DETAILED DESCRIPTION OF THE INVENTION

Figure 1:
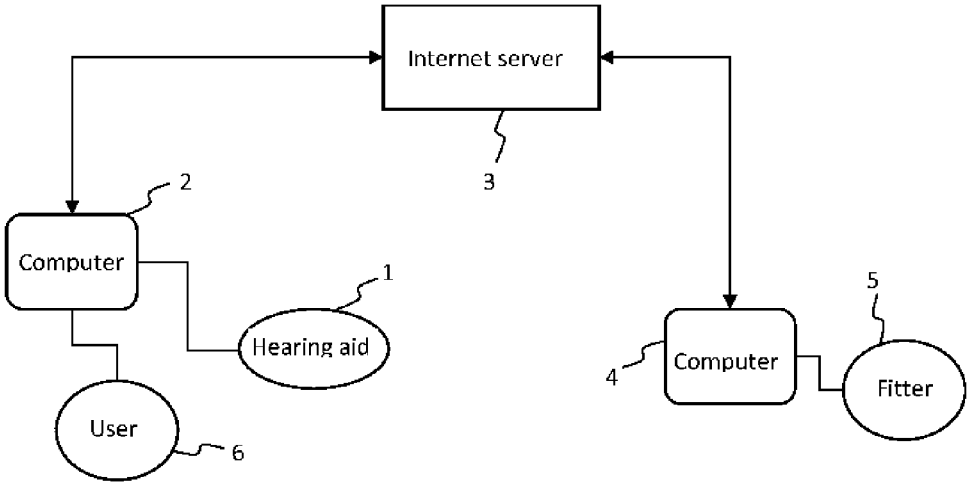
FIG. 1 illustrates a schematic setup for carrying out an embodiment of the invention.

FIG. 1 illustrates one of several possible arrangements for carrying out the method of the invention. The method includes a recording of the audiogram of the hearing aid user 6 and based on this selecting a fitting setting for the hearing aid 1. This setting is implemented in the hearing aid, using the hearing aid by the hearing aid user for a period of time. The hearing aid 1 is provided with means for logging data representing statistical data on the sound environment in which the hearing aid 1 is being used.

The hearing aid 1 is preferably connectable to the internet, either directly, or through an external unit such as a first computer 2. The first computer 2 may be an ordinary personal computer or any unit, such as a mobile phone, which is connectable to the internet and which can be provided with, or running via an internet browser, software for filling out a questionnaire. The logged data may be transferred through an internet server 3 to a second computer 4 of a hearing aid fitter 5. The logged data may also be directly transferred to the second computer 4 during a visit to the fitter 5. The logged data may also be temporarily stored on an external memory such as a computer or any electronic device comprising a memory and being connectable with the hearing aid, through either a wireless or a wired connection. This could be relevant when the hearing aid memory is full. It should be understood that the first computer could be more than one device. One first computer is a unit applied by the hearing aid user, or a relative or friend, for filling in and uploading the questionnaire data. The same or a different first computer may be used for storage and uploading of logged data.

As described in International Application PCT/DK2007/050072, filed 13 Jun. 2007 (published as WO-A1-2008/151625) the hearing aid program preferred by the user in a specific sound environment may also be logged in the hearing aid memory. This may also be relevant information for the fitter when selecting a fine tuning of the hearing aid settings. If the hearing aid user in a specific type of sound environment often selects a program different from the one expected or intended, this could indicate that the hearing aid settings for the expected program are not optimal for the hearing aid user's specific needs.

The hearing aid user 6 is having access to the first computer 2. Through this computer, or in practice through any computer, mobile phone or device with an internet connection, the user 6 is able to access a questionnaire with questions concerning the experience with applying the hearing aid 1. A questionnaire comprises different categories of questions primarily directed to the users experience in different types of listening situations. In each category several questions could be asked with multiple choice answering possibilities, e.g. asking the hearing aid user to select the one of five statements fitting best with the experience of the user. An example of questions is given in table 1 below.

TABLE 1

| |
|---|
| 1. How often do you use your hearing aids? |
| 2. Do you have any difficulty placing your hearing aids in your ears? |
| 3. Once the hearing aid placed correctly in your ears, does it whistle (feedback)? |
| 4. Is the physical fit of your hearing aids or earmoulds comfortable? |
| 5. Do you have any difficulties when handling your hearing aids? |
| 6. How is the overall loudness? |
| 7. Is the loudness between the two hearing aids the same (balanced)? |
| 8. How is the overall pitch? |
| 9. When listening to speech in quiet, how is the volume of speech? |
| 10. When listening to speech in quiet, how is the sound quality (clarity) of speech? |
| 11. Do distant voices seem more audible than voices nearby? |
| 12. When watching TV with the TV volume adjusted to suit another person, how often can you follow the program? |
| 13. How is the sound quality (clarity) of speech, when having a conversation while several people are talking in the same time (e.g. having a conversation at eating situations, cocktail party etc)? |
| 14. How is the volume of the speech, when having a conversation while several people are talking in the same time (e.g. having a conversation at eating situations, cocktail party etc)? |
| 15. How is the sound quality (clarity) of speech, when having a conversation in a noisy place (e.g. bus station, shopping center etc)? |
| 16. How is the volume of speech, when having a conversation in a noisy place (e.g. bus station, shopping center, busy street etc)? |
| 17. How much speech can you understand with a moderate background noise around you? |
| 18. In quiet surrounds is the volume of soft speech (e.g. somebody speaking softly) adequate for you? |
| 19. In quiet surrounds is the volume of soft sounds adequate for you |
| 20. Do you often find environmental sounds annoying? |
| 21. Do you ever find loud sounds uncomfortable? |
| 22. If you consider loud sounds uncomfortable, please indicate how often: |
| 23. Are loud sounds ever distorted? |
| 24. How often loud sounds (e.g. loud music, movie sound effects, motors or machinery) are turned down too much? |
| 25. Is the sound quality of your own voice acceptable, when wearing your hearing aids? |

The answering possibilities are not included in table 1, but will often be of the multiple choice type. The hearing aid user 6 may be asked to fill out the questionnaire within a specific period.

The user may also be asked to fill out the questionnaire two or more times. The questionnaire could comprise questions to make the user 6 relate specific experiences with the hearing aid to one or more specific time periods. Such information would enable the fitter 6 to compare the users experience directly with logged information on a specific sound environment.

To achieve such a relationship between the logged data and the questionnaire data the logged data could be transferred to the first computer relatively often, e.g. once a day, and a software program on the computer could analyze these data immediately in order to identify periods with an especially relevant sound environment. This could e.g. be a sound environment challenging to the hearing aid user and therefore a sound environment with higher demands to an optimum adjustment of the hearing aid settings. It would be advantageous if at least some of the questions in the questionnaire are directed specifically to the time period with such a sound environment. This could be done by specifically addressing questions to the experience of the user within this time period. The software controlling the questionnaire should communicate with the software analyzing the logged data in order to give the user an indication of the time period referred to in the question. Furthermore, it would be advantageous if the user is prompted to fill in the questionnaire shortly after the period with the relevant sound environment, thereby making it easier for the user to remember the experience with the functioning of the hearing aid.

When the hearing aid user has filled out the questionnaire forming a set of questionnaire data, these data can be uploaded to an internet server. From the internet server the data can be downloaded to the second computer 4. In practice the fitting software on the second computer 4 may be set up for checking if any new data has been uploaded to the internet server from a hearing aid user at regular intervals, e.g. preferably at least once a day.

Figure 2:
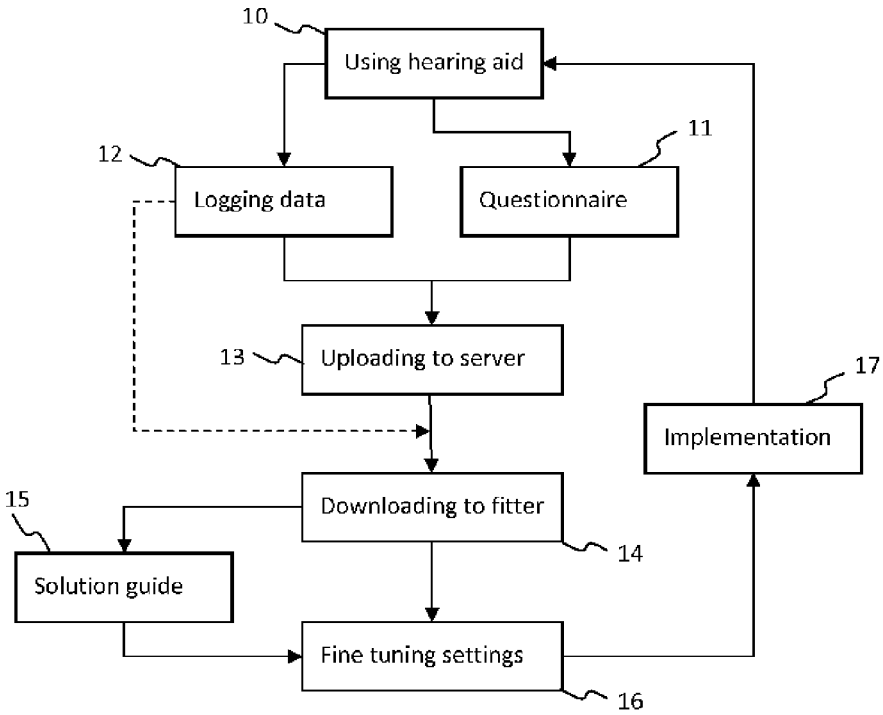
FIG. 2 illustrates a flowchart of steps in a method of an embodiment of the invention.

FIG. 2 shows a flowchart of a method according to an embodiment of the invention, where it is indicated when starting from the top 10 that the hearing aid should be in use and preferably be used for some time, e.g. at least 1-4 weeks after fitting or latest fine tuning, before filling out the questionnaire 11. Logging of data 12 will be done continuously when the hearing aid is used. The logged data as well as the filled out questionnaire, or the data originating from the filled out questionnaire, can now be uploaded to an internet server 13. From this server the data is downloaded by the fitter 14. Alternatively, the logged data can be transferred directly to the computer of the fitter, e.g. while the hearing aid user is visiting the fitter.

Based on the logged data as well as the questionnaire data, the fitter can now decide on an adjustment of the hearing aid settings, i.e. the fine tuning settings 16. For assistance in this decision the fitter may apply a so-called solution guide 15, i.e. a database with advice on adjustments of the hearing aid settings. These advices are based on the score of the questionnaire data in specific categories of questions, and are developed from experience with a large number of hearing aid users. The solution guide database also comprises information on the hearing loss of the user and the specific settings of the hearing aid including earlier adjustments. When a fine tuning 16 has been decided on, the new settings have to be implemented 17 to the hearing aid. This will usually be done directly during a visit of the hearing aid user at the fitter. The communication from the fitter's computer to the hearing aid may be wired or wireless. Alternatively, the new settings of the hearing aid may also be implemented 17 over the internet.

When the fitter 5 has both the data logged by the hearing aid and the questionnaire data it will be possible to obtain a considerably better judgment of the functioning of the hearing aid in relation to the needs of the user, as compared to only having one set of data. This better judgment can also be applied for achieving a better fine tuning of the hearing aid. In practice the two sets of data may be imported to the same software, which has been developed to guide the fitter to an optimal adjustment of the hearing aid based on such data input. The above mentioned solution guide database may also preferably be part of this software.

The software may be set up for giving the fitter a number of hints based on the combined datasets. Alternatively, the software will simply present the data in a form offering the fitter the best possible overview. The fitter will then fine tune the parameters of the hearing aid based on these hints or data, and preferably also based on the fitters experience and discussion with the hearing aid user.

The fitter will typically write the new fine tuned parameters to the hearing aid during the visit of the hearing aid user. In some cases, however, the fitter may also select to analyze the data and to select a fine tuning of the hearing aid, without a face to face discussion with the hearing aid user just after a telephone conversation or a written correspondence. In this last situation the fitter may implement the new adjusted settings into the hearing aid through the internet.

We claim:

1. A method for fitting a hearing aid to the needs of a hearing aid user comprising the steps of recording the audiogram of the hearing aid user, selecting a fitting setting and implementing the setting in the hearing aid, using the hearing aid by the hearing aid user for a period of time, logging data representing information on the sound environment in which the hearing aid is being used, said data being logged in a memory in the hearing aid, providing a computer-based questionnaire on a first computer, said questionnaire comprising a number of questions directed to the hearing aid users subjective experience with using said hearing aid fitted to the specific hearing loss of the hearing aid user, where each of said questions are to be answered by an indication on a predefined scale, requesting the hearing aid user to fill out said questionnaire, uploading questionnaire data representing the filled out questionnaire to an internet server, downloading said questionnaire data from said internet server to a second computer, transferring said logged data to said second computer, correlating said downloaded questionnaire data with said logged data, wherein data logged in a specific sound environment are compared with questionnaire data corresponding to that specific sound environment, selecting a new hearing aid setting, and implementing the new hearing aid setting into the hearing aid.

2. The method according to claim 1, wherein said logged data is transferred from the hearing aid to a logged data uploading computer from which the data is uploaded to the internet server, from where the data can be downloaded to said second computer.

3. The method according to claim 1, wherein said questionnaire data and said logged data are analyzed in the same software package on said second computer, said software package being applied for selecting the new hearing aid setting.

4. The method according to claim 2, wherein said new hearing aid setting is uploaded to the internet server from where it is downloaded to the first computer, and said new hearing aid setting is subsequently implemented into the hearing aid.

5. The method according to claim 1, wherein the questions in said questionnaire are of the multiple choice type.

6. The method according to claim 1, wherein said questionnaire is filled out at least two times on separate days before selecting said new hearing aid setting.

7. The method according to claim 1, wherein said questionnaire comprises questions directed to the hearing aid users experience with the hearing aid in a specific time period.

8. The method according to claim 2, comprising synchronizing the clock of the hearing aid by setting the clock of the hearing aid to the time of said logged data uploading computer, or to the internet time, whenever the first hearing aid is connected to the logged data uploading computer.

9. The method according to claim 1, wherein said user data comprises user data corresponding to usage in a specific period of time, said logging step includes associating time data with said sound environment information, and said comparing step comprises comparing said user data with logged data associated with said specific period of time.

10. A method for optimizing the function of a hearing aid, comprising providing a number of hearing aid users with hearing aids, for each respective user recording the audiogram of the respective hearing aid user, selecting a fitting setting and implementing the setting in the respective hearing aid, using the respective hearing aid by the respective hearing aid user for a period of time, logging data representing information on the sound environment in which the respective hearing aid is being used, said data being logged in a memory in the respective hearing aid, providing a computer-based questionnaire on a respective first computer, said questionnaire comprising a number of questions directed to the respective hearing aid users subjective experience with using the hearing aid fitted to the specific hearing loss of the respective hearing aid user, where each of said questions are to be answered by an indication on a predefined scale, requesting the respective hearing aid user to fill out said questionnaire, uploading questionnaire data representing the filled out questionnaire to an internet server, downloading said questionnaire data from said internet server to a second computer, transferring said logged data to said second computer, and correlating said downloaded questionnaire data with said logged data, wherein data logged in a specific sound environment are compared with questionnaire data corresponding to that specific sound environment, wherein the data from respective users collected in the second computer are analyzed statistically in order to identify features of the hearing aid fitting that merit further study.

11. A computer program product comprising a non-transitory computer readable medium carrying executable program code which, when executed on a computer, correlates downloaded questionnaire data corresponding to usage of a hearing aid in a specific sound environment with logged hearing aid data from that specific sound environment, said two types of data being obtained by providing a user with said hearing aid;

recording the audiogram of the hearing aid user;

selecting a fitting setting and implementing the setting in the hearing aid;

using the hearing aid by the hearing aid user for a period of time;

logging data representing information on the sound environment in which the hearing aid is being used, said data being logged in a memory in the hearing aid;

providing a computer-based questionnaire on a first computer, said questionnaire comprising a number of questions directed to the hearing aid users subjective experience with using the hearing aid fitted to the specific hearing loss of the hearing aid user, where each of said questions are to be answered by an indication on a predefined scale;

requesting the user of said hearing aid to fill out said questionnaire;

uploading questionnaire data representing the filled out questionnaire to an internet server;

downloading said questionnaire data from said internet server to a second computer; and transferring said logged data to said second computer.

12. A method for fitting a hearing aid to the needs of a hearing aid user comprising the steps of:

using the hearing aid by the hearing aid user with a first setting, for a period of time in a specific sound environment, logging data in a memory of the hearing aid representing information on said specific sound environment during said time period;

storing on a first computer user data representing input by said user, in response to a computer-based questionnaire comprising a number of questions relating to the subjective experience of said user in said specific sound environment, transferring said user data from said first computer to a second computer, transferring said logged data to said second computer, comparing said user data and logged data; and adjusting the setting of said hearing aid in accordance with said comparison.

13. The method according to claim 12, wherein said logging step comprises logging data corresponding to usage of said hearing aid in multiple sound environments, and said specific sound environment is one of said multiple sound environments.

14. The method according to claim 12, wherein said logged data is transferred from the hearing aid to a first computer from which the data is uploaded to an internet server, from where the data can be downloaded to a second computer at which said comparing step is performed.

15. A method for fitting a hearing aid to the needs of a hearing aid user comprising the steps of:

using the hearing aid by the hearing aid user with a first setting during a logging time period;

logging data in a memory of the hearing aid during at least said logging time period;

storing on a first computer user data representing input from the user, in response to a computer-based questionnaire comprising a number of questions relating to the subjective experience of said user during a specific time period shorter than and contained within said logging time period;

transferring said user data from said first computer to a second computer;

transferring said logged data to said second computer;

comparing said user data with data selected from said logged data and corresponding to said specific time period; and adjusting the setting of said hearing aid in accordance with said comparison.

16. A computer program product comprising a non-transitory computer-readable medium carrying executable program code which, when executed on a first computer, correlates user input data corresponding to usage of a hearing aid during a specific time period with stored data corresponding to usage of said hearing aid during said specific time period and selected from data logged over a larger time period including said specific time period, wherein said stored data is data which has been stored in a memory of said hearing aid during said specific time period and subsequently transferred to said first computer, and wherein said user input data is data obtained at a second computer in response to a computer-based questionnaire comprising a number of questions relating to the subjective experience of a user during said specific time period and is thereafter transferred from said second computer to said first computer.

17. The computer program product according to claim 16, wherein said stored data represents information on a sound environment in which said hearing aid was used during said specific time period.

* * * * *